US005824633A

United States Patent [19]

Kischkel et al.

[11] Patent Number: 5,824,633

[45] Date of Patent: Oct. 20, 1998

[54] HETEROGENEOUS SURFACTANT GRANULES

[75] Inventors: Ditmar Kischkel, Monheim; Karl Schmid, Mettman; Andreas Syldath, Monheim; Thomas Krohnen, Duesseldorf, all of Germany

[73] Assignee: Henkel Kommanditgesellschaft auf Aktien, Duesseldorf, Germany

[21] Appl. No.: 732,422

[22] PCT Filed: Apr. 24, 1995

[86] PCT No.: PCT/EP95/01544

§ 371 Date: Jan. 31, 1997

§ 102(e) Date: Jan. 31, 1997

[87] PCT Pub. No.: WO95/29981

PCT Pub. Date: Nov. 9, 1995

[30] Foreign Application Priority Data

May 2, 1994 [DE] Germany ..... 44 15 369.4

[51] Int. Cl.[6] ..... C11D 17/00

[52] U.S. Cl. ..... 510/349; 510/351; 510/352

[58] Field of Search ..... 570/349

[56] References Cited

U.S. PATENT DOCUMENTS

| | | | |
|---|---|---|---|
| 4,731,195 | 3/1988 | Olson | 510/349 |
| 4,826,632 | 5/1989 | Blackburn et al. | 510/349 |
| 5,215,683 | 6/1993 | Kravetz et al. | 510/349 |
| 5,399,297 | 3/1995 | Panthal et al. | 252/550 |
| 5,443,751 | 8/1995 | Mazzola | 510/349 |
| 5,482,646 | 1/1996 | Mazzola | 510/349 |

FOREIGN PATENT DOCUMENTS

| | | |
|---|---|---|
| 208 534 | 1/1987 | European Pat. Off. . |
| 342 917 | 11/1989 | European Pat. Off. . |
| 353 976 | 2/1990 | European Pat. Off. . |
| 21 24 526 | 12/1971 | Germany . |
| 25 58 593 | 7/1977 | Germany . |
| 40 30 688 | 4/1992 | Germany . |
| 41 24 701 | 1/1993 | Germany . |
| 42 42 185 | 6/1994 | Germany . |
| 92/09676 | 6/1992 | WIPO . |
| 93/15180 | 8/1993 | WIPO . |
| 95/02390 | 1/1995 | WIPO . |
| 95/08616 | 3/1995 | WIPO . |

*Primary Examiner*—Ellen M. McAvoy
*Attorney, Agent, or Firm*—Ernest G. Szoke; Wayne C. Jaeschke; Real J. Grandmaison

[57] ABSTRACT

Heterogenous surfactant granules consisting of an inner core containing a) alkyl sulfates corresponding to formula (I):

$$R^1O—SO_3X \quad (I)$$

in which $R^1$ is an alkyl radical containing 16 to 18 carbon atoms and X is an alkali metal or alkaline earth metal, ammonium, alkylammonium, alkanolammonium or glucammonium, and b1) alkyl sulfates corresponding to formula (II):

$$R^2O—SO_3X \quad (II)$$

in which $R^2$ is an alkyl radical containing 12 to 14 carbon atoms and X is as defined above, or b2) alkyl ether sulfates corresponding to formula (III):

$$R^3O(CH_2CH_2)_nSO_3X \quad (III)$$

in which $R^3$ is an alkyl radical containing 16 to 18 carbon atoms, n is a number of 1 to 3 and X is as defined above, and a coating over the inner core consisting of alkyl sulfates corresponding to formula (II), with the provisos that the ratio by weight of component a) to component b) in the inner core is 100:0 to 30:70, and the ratio by weight of the inner core to the coating is 99.5:0.5 to 90:10.

12 Claims, No Drawings

HETEROGENEOUS SURFACTANT GRANULES

BACKGROUND OF THE INVENTION

1. Field of the Invention

This invention relates to heterogeneous surfactant granules with an inner core consisting of relatively long-chain alkyl sulfates or mixtures thereof with relatively short-chain homologs or alkyl ether sulfates and of a coating of relatively short-chain alkyl sulfates. The present invention also relates to a process for the production of the heterogeneous surfactant granules.

2. Discussion of Related Art

Anionic surfactants, more particularly alkyl sulfates or fatty alcohol sulfates, are important components of laundry detergents, dishwashing detergents and cleaning compositions. In contrast to nonionic surfactants which show inverse solubility behavior and better solubility in cold water than in warm water through the presence of hydrogen bridge bonds, anionic surfactants exhibit conventional behavior, i.e. their solubility increases more or less linearly with temperature until the solubility product is reached. However, for technical applications, for example with regard to dispensing behavior during the washing process, there is a need for anionic surfactants which also show adequate solubility in cold water.

There has been no shortage of attempts in the past to solve the problem posed by the inadequate solubility of anionic surfactants, particularly alkyl benzene sulfonates, fatty alcohol sulfates and a-methyl ester sulfonates, in cold water. These efforts have largely been based on two concepts, namely:

a) the use of hydrotropes and b) surface enlargement of the surfactant granule.

The most well-known hydrotropes undoubtedly include the short-chain alkylaryl sulfonates such as, for example, toluene, xylene or cumene sulfonate. They are suitable, for example, as solubilizers for anionic and nonionic surfactants in the production of liquid detergents. The improved solubility is probably attributable to advantageous mixed micelle formation. Reference is made in this connection to the review by H. Stache in *Fette, Seifen, Anstrichmitt.* 71, 381 (1969).

However, the improvement in cold water solubility, particularly in the case of fatty alcohol sulfates, is normally achieved by adding surfactants with high HLB values, for example highly ethoxylated polyglycol ethers (tallow alcohol 40 EO adduct) or the like, to them as hydrotropes. However, the dissolving rates obtainable in this way, particularly in the case of fatty alcohol sulfates, are unsatisfactory for a number of technical applications.

A totally different approach for improving the solubility of anionic surfactants is described in German patent application DE-A1 4030688 (Henkel) where it is proposed to dry water-containing surfactant pastes with superheated steam. Through the condensation of the superheated steam on the cooler starting material and release of the heat of condensation to the material to be dried, the surfactant droplets are spontaneously heated to the boiling temperature of the water. As a result, a plurality of fine channels is formed in the surfactant granule as the water escapes. The large inner surface obtained in this way leads to a considerably improved dissolving rate, for example by comparison with conventionally spray-dried products. Nevertheless, the described process is attended by the disadvantage of high outlay on equipment.

According to DE-A1 4124701 (Henkel), solid detergents of high apparent density and improved solubility are obtained by adding polyethylene glycol ethers with a molecular weight of 200 to 12,000 and preferably 200 to 600 to mixtures of anionic and nonionic surfactants and then drying and/or solidifying the resulting mixtures. Example 1 discloses a detergent formulation containing $C_{12/18}$ fatty alcohol sulfate, $C_{12/18}$ fatty alcohol 5 EO/$C_{16/18}$ tallow fatty alcohol 5 EO adduct and—based on the nonionic surfactants—not less than 45% by weight of polyethylene glycol with a molecular weight of around 400 which, after homogenization, is extruded and processed to granules. Unfortunately, the dissolving rate of the solid detergents obtained is still not satisfactory. In addition, the presence of the large quantities of polymer required is undesirable.

EP-A2 0208534 generally discloses spray-dried detergent formulations which, in addition to anionic surfactants, contain nonionic surfactants, polyacrylates and polyethylene glycol ethers with an average molecular weight of 1,000 to 20,000. According to the teaching of this document, the dispersibility of anionic surfactants can be improved by adding nonionic surfactants, polyethylene glycol ethers and polyacrylates to them.

DE-OS 2124526 relates to foam-regulated detergent and cleaning mixtures. Example 6 discloses compositions which contain tallow alcohol sulfate, alkyl benzene sulfonate and polyethylene glycol with a molecular weight of around 20,000.

Other process developments concerned with the production of solid anionic surfactants are only mentioned in passing at this juncture. For example, International patent application WO 92/09676 (Henkel) describes solid detergents which are obtained by treating water-containing alkyl sulfate pastes with soda and zeolites and extruding the resulting compound. There is no reference in the document in question to the dissolving rate of the solids.

Now, the problem addressed by the present invention was to provide new formulations of alkyl sulfates which, even after mechanical compaction, would be light in color and would show improved solubility in cold water.

DESCRIPTION OF THE INVENTION

The present invention relates to heterogenous surfactant granules consisting of an inner core containing a) alkyl sulfates corresponding to formula (I):

$$R^1O—SO_3X \quad (I)$$

in which $R^1$ is an alkyl radical containing 16 to 18 carbon atoms and X is an alkali metal or alkaline earth metal, ammonium, alkylammonium, alkanolammonium or glucammonium, and b1) alkyl sulfates corresponding to formula (II):

$$R^2O—SO_3X \quad (II)$$

in which $R^2$ is an alkyl radical containing 12 to 14 carbon atoms and X is as defined above, and/or b2) alkyl ether sulfates corresponding to formula (III):

$$R^3O(CH_2CH_2)_nSO_3X \quad (III)$$

in which $R^3$ is an alkyl radical containing 16 to 18 carbon atoms, n is a number of 1 to 3 and X is as defined above, and of a coating consisting of alkyl sulfates corresponding to formula (II), with the provisos that the ratio by weight of component a) to component b) in the inner core is 100:0 to 30:70 and preferably 90:10 to 70:30 and the ratio by weight of inner core to coating is 99.5:0.5 to 90:10.

In extensive studies, applicants have found that the solubility behavior of tallow alkyl sulfates, which show particularly advantageous washing power, can be significantly improved by a defined percentage content of relatively short-chain homologs without any deterioration in washing performance. Applicants have also found that the structuring of the surfactant core into zones of relatively long-chain and relatively short-chain alkyl sulfates separated from one another by hydrophobic structure breakers further improves solubility. All these discoveries are the subject of a number of hitherto unpublished patent applications. Now, the new teaching lies in the surprising observation that structured, i.e. heterogeneous, alkyl sulfate granules with further improved solubility can be obtained when an inner core which contains the relatively long-chain alkyl sulfate, optionally in admixture with relatively short-chain homologs or selected alkyl ether sulfates, is encapsulated by granulation in a coating of a relatively short-chain alkyl sulfate of defined layer thickness.

The present invention also relates to a process for the production of heterogeneous surfactant granules, in which a dry anionic surfactant powder containing a) 30 to 100% by weight and preferably 70 to 90% by weight of alkyl sulfates corresponding to formula (I):

$$R^1O—SO_3X \quad (I)$$

in which $R^1$ is an alkyl radical containing 16 to 18 carbon atoms and X is an alkali metal or alkaline earth metal, ammonium, alkylammonium, alkanolammonium or glucammonium, and b1) 0 to 70% by weight and preferably 10 to 30% by weight of alkyl sulfates corresponding to formula (II):

$$R^2O—SO_3X \quad (II)$$

in which $R^2$ is an alkyl radical containing 12 to 14 carbon atoms and X is as defined above, and/or b2) 0 to 70% by weight and preferably 10 to 50% by weight of alkyl ether sulfates corresponding to formula (III):

$$R^3O(CH_2CH_2)_nSO_3X \quad (III)$$

in which $R^3$ is an alkyl radical containing 16 to 18 carbon atoms, n is a number of 1 to 3 and X is as defined above, is coated in a mixer/dryer with a water-containing paste of an alkyl sulfate corresponding to formula (II) in such a way that a ratio by weight of inner surfactant core to coating of 99.5:0.5 to 90:10 is established.

Alkyl Sulfates and Alkyl Ether Sulfates

Alkyl sulfates and alkyl ether sulfates in the context of the present invention are the sulfation products of primary alcohols or ethylene oxide adducts thereof.

According to the invention, relatively long-chain alkyl sulfates containing 16 to 18 carbon atoms, which have particularly advantageous washing properties, may be used as component a). Typical examples of such alkyl sulfates are cetyl sulfate and stearyl sulfate and, preferably, tallow alkyl sulfate or technical mixtures of comparable composition.

In the most simple case, component a) may make up as much as 100% by weight of the inner core. However, a mixture which, in addition to component a), contains either even shorter alkyl sulfates containing 12 to 14 carbon atoms (component b1) and/or alkyl ether sulfates containing 16 to 18 carbon atoms and 1 to 3 and preferably around 2 ethylene oxide units (component b2) is preferably used. Where mixtures such as these are used, the ratio by weight between components a) and b) is normally in the range from 70:30 to 98:2 and is preferably in the range from 80:20 to 90:10.

The coating of the inner core also consists of relatively short-chain alkyl sulfates containing 12 to 14 carbon atoms. Typical examples are lauryl sulfate, myristyl sulfate or technical mixtures, for example based on a cocofatty alcohol cut. Granulation is carried out in such a way that a coating with a layer thickness corresponding to 0.5 to 10% by weight, preferably 1 to 5% by weight and more preferably 1.5 to 2% by weight, based on the granules, is obtained.

One particularly preferred embodiment of the invention is characterized by the use of alkyl sulfates which have a degree of sulfonation of 60 to 80 and preferably of around 70% by weight and which therefore still contain a significant proportion of unsulfonated starting materials for component a) and, more particularly, for component b1). The invention includes the observation that undersulfonated alkyl sulfates such as these as coatings for the inner surfactant core lead to a particularly light color.

Dry Surfactant Powders

The substances which make up component a), i.e. the inner core, either on their own or in admixture are used as dry powders. A dry tallow alkyl sulfate powder may be produced, for example, by subjecting an aqueous sulfuric acid semiester of a corresponding tallow alcohol to spray neutralization after sulfation. A neutralized water-containing paste may also be dried in a conventional spray tower or with superheated steam (cf. DE-A1 4124701, Henkel). If the inner core is to consist of a mixture of the $C_{16/18}$ alkyl sulfates with components b1) and/or b2), the mixtures may be prepared either mechanically by mixing the ingredients or by co-sulfation of the corresponding hydroxyl compounds. The sulfates are normally present as alkali metal salts and preferably as sodium salts.

Granulation

Granulation may be carried out continuously or discontinuously in known manner in a mixer/dryer, for example in a Lödige mixer, in a Drais mixer, in a Schugi mixer or in a Fukai mixer, or even in a fluidized bed.

In a first embodiment, the heterogeneous surfactant granules are produced by coating a $C_{16/18}$ tallow alkyl sulfate powder with $C_{12/14}$ cocoalkyl sulfate using water as the granulation liquid.

In one preferred embodiment, tallow alkyl sulfate powder or a powder-form mixture of tallow alkyl sulfate and lauryl sulfate or tallow alkyl 2 EO sulfate (ratio by weight 90:10), for example, is coated with a 35% by weight or 65% by weight water-containing paste of lauryl sulfate.

It has also been found to be of advantage to carry out granulation in such a way that most of the particles obtained, i.e. at least 90% by weight, have a diameter of 0.2 to 1.4 mm and preferably 0.2 to 0.8 mm. Coarse granules, if any, may be removed by sieving.

Commercial Applications

The surfactant granules according to the invention dissolve rapidly in cold water and in warm water and show improved dispensing behavior in washing machines. Another advantage is that their color quality is not adversely affected during their mechanical compaction.

The surfactant granules according to the invention may be mixed or even agglomerated or extruded with other detergent ingredients and, accordingly, are suitable as raw materials for the production of solid detergents.

The following Examples are intended to illustrate the invention without limiting it in any way.

EXAMPLES

I. Influence of the Granulation Liquid

COMPARISON EXAMPLE C1

An acidic sulfuric acid semiester based on $C_{16/18}$ tallow alcohol was subjected to spray neutralization. The dried powder-form $C_{16/18}$ tallow alcohol sulfate sodium salt was then processed to granules in a Lödige mixer in the presence of added water.

COMPARISON EXAMPLE C2

A water-containing paste of $C_{16/18}$ tallow alkyl sulfate sodium salt with a solids content of around 50% by weight was dried with superheated steam. The water-free powder was then processed to granules in a Lödige mixer in the presence of added water.

EXAMPLE 1

An acidic sulfuric acid semiester based on C16/18 tallow alcohol and $C_{12/14}$ cocofatty alcohol (ratio by weight 90:10) was subjected to spray neutralization. The dried powder-form $C_{12/18}$ fatty alcohol sulfate sodium salt was then processed to granules in a Lödige mixer in the presence of added water.

EXAMPLE 2

Comparison Example C1 was repeated. The water was replaced by a water-containing paste of lauryl sulfate sodium salt with a solids content of 35% by weight (Texapon® LS35, Henkel KGaA, Düsseldorf, FRG). The ratio by weight of inner core to coating was 1.5% by weight, based on the solids content of the granulation liquid.

EXAMPLE 3

Comparison Example C1 was repeated. The water was replaced by a water-containing paste of lauryl sulfate sodium salt with a solids content of 35% by weight (Texapon® LS35, Henkel KGaA, Düseldorf, FRG). The ratio by weight of inner core to coating was 2.5% by weight, based on the solids content of the granulation liquid.

EXAMPLE 4

Comparison Example C1 was repeated. The water was replaced by a water-containing paste of lauryl sulfate sodium salt with a solids content of 65% by weight (Texapon® LS35, Henkel KGaA, Düseldorf, FRG). The ratio by weight of inner core to coating was 1.5% by weight, based on the solids content of the granulation liquid.

EXAMPLE 5

A water-containing paste of $C_{16/18}$ tallow alkyl sulfate sodium salt with a solids content of around 50% by weight was conventionally spray-dried. The water-free powder was mixed with a spray-neutralized powder of $C_{12/14}$ cocoalkyl sulfate sodium salt in a ratio by weight of 90:10 and then granulated in a Lödige mixer in the presence of a water-containing paste of lauryl sulfate sodium salt with a solids content of 35% by weight (Texapon® LS 35, Henkel KGaA, Düseldorf, FRG). The ratio by weight of inner core to coating was 1.5% by weight, based on the solids content of the granulation liquid.

EXAMPLE 6

The procedure was as in Example 5, except that the cocoalkyl sulfate was replaced by $C_{16/18}$ tallow alcohol 2EO sulfate sodium salt.

EXAMPLE 7

A spray-dried mixed powder consisting of $C_{16/18}$ tallow alkyl sulfate, $C_{12/14}$ cocoalkyl sulfate and $C_{16/18}$ tallow alcohol 1 EO sulfate (in the form of their sodium salts, ratio by weight 35:25:40) was granulated in a Lödige mixer in the presence of a water-containing paste of lauryl sulfate sodium salt with a solids content of 35% by weight. The ratio by weight of inner core to coating was 2% by weight, based on the solids content of the granulation liquid.

EXAMPLE 8

The procedure was as in Example 5, except that the spray-dried tallow alkyl sulfate was replaced by material dried with superheated steam.

At least 90% by weight of all the granules investigated had a particle size of 0.2 to 1.4 mm.

Description of the Handwashing Test

To determine solubility, 32 g of the granules of Examples 1 to 8 and Comparison Examples C1 and C2 were dissolved in 4 l of water (16° d) at 30° C. A cushion (53×32 cm) of black Nicki cloth was then kneaded and turned in the liquor to simulate a handwashing process. The cushion was wrung out and the wash liquor was left to settle for 15 s. The insoluble particles were quantitatively filtered through a sieve and the residue was dried to constant weight at 60° C. in a drying cabinet.

The test results are set out in Table 1 (average of double determination, percentages as % by weight).

TABLE 1

Handwashing tests: influence of the granulation liquid

| Ex. | cTAS % | cCAS % | cTAES % | DP | GP | Residue % rel. |
|---|---|---|---|---|---|---|
| 1 | 90 | 10 | 0 | SN | Water | 31.1 |
| 2 | 100 | 0 | 0 | SN | 1.5% by weight LS35 | 26.7 |
| 3 | 100 | 0 | 0 | SN | 2.5% by weight LS35 | 26.3 |
| 4 | 100 | 0 | 0 | SN | 1.5% by weight LS65 | 26.7 |
| 5 | 90 | 10 | 0 | SN | 1.5% by weight LS35 | 25.7 |
| 6 | 90 | 0 | 10 | SN | 1.5% by weight LS35 | 26.2 |
| 7 | 35 | 25 | 40 | SN | 2.0% by weight LS35 | 30.0 |
| 8 | 90 | 10 | 0 | DSH | 1.5% by weight LS35 | 25.2 |
| C1 | 100 | 0 | 0 | SN | Water | 60.3 |
| C2 | 100 | 0 | 0 | DSH | Water | 59.8 |

Legend:
cTAS = Concentrat. tallow alkyl sulfate in the inner core
cCAS = Concentrat. cocoalkyl sulfate in the inner core
cTAES = Concentrat. tallow alcohol ether sulfate in the inner core
DP = Drying process
SN = Spray neutralization/spray drying
DSH = Drying with superheated steam
GP = Granulation process II. Influence of Particle Size Example 5 was repeated. However, granules of varying particle size distribution were produced by varying the speed of the mixer, the mass flow and the mixing time. The results are set out in Table 2:

TABLE 2

| Handwashing test: influence of particle size | | | | |
|---|---|---|---|---|
| | Particle Size Distribution | | | |
| Ex. | <0.2 mm % by weight | 0.2–1.4 mm % by weight | >1.4 mm % by weight | Residue % rel. |
| 8 | 2 | 90 | 8 | 25.7 |
| 9 | 1 | 93 | 6 | 25.1 |
| C2 | 5 | 85 | 10 | 28.2 |
| C3 | 7 | 82 | 12 | 31.0 |

What is claimed is:

1. Heterogenous surfactant granules having an inner core consisting of a) alkyl sulfates corresponding to formula (I):

$$R^1O—SO_3X \quad (I)$$

in which $R^1$ is an alkyl radical containing 16 to 18 carbon atoms and X is an alkali metal or alkaline earth metal, ammonium, alkylammonium, alkanolammonium or glucammonium, and b1) alkyl sulfates corresponding to formula (II):

$$R^2O—SO_3X \quad (II)$$

in which $R^2$ is an alkyl radical containing 12 to 14 carbon atoms and X is as defined above, or b2) alkyl ether sulfates corresponding to formula (III):

$$R^3O(CH_2CH_2)_nSO_3X \quad (III)$$

in which $R^3$ is an alkyl radical containing 16 to 18 carbon atoms, n is a number of 1 to 3 and X is as defined above, and a coating over said inner core consisting of alkyl sulfates corresponding to formula (II), with the provisos that the ratio by weight of component a) to component b) in the inner core is 100:0 to 30:70, and the ratio by weight of said inner core to said coating is 99.5:0.5 to 90:10.

2. Heterogenous surfactant granules as in claim 1 having a diameter of 0.2 to 1.4 mm.

3. Heterogenous surfactant granules as in claim 1 wherein said component a) is selected from the group consisting of cetyl sulfate, stearyl sulfate, tallow alkyl sulfate, and mixtures thereof.

4. Heterogenous surfactant granules as in claim 1 wherein said component b2) contains 1 to 3 ethylene oxide units.

5. Heterogenous surfactant granules as in claim 1 wherein said coating is selected from the group consisting of lauryl sulfate, myristyl sulfate, and mixtures of cocoalkyl sulfate.

6. A process for the production of heterogeneous surfactant granules comprising coating an inner core of a dry anionic surfactant powder consisting of a) 30 to 100% by weight of alkyl sulfates corresponding to formula (I):

$$R^1O—SO_3X \quad (I)$$

in which $R^1$ is an alkyl radical containing 16 to 18 carbon atoms and X is an alkali metal or alkaline earth metal, ammonium, alkylammonium, alkanolammonium or glucammonium, b1) 0 to 70% by weight of alkyl sulfates corresponding to formula (II):

$$R^2O—SO_3X \quad (II)$$

in which $R^2$ is an alkyl radical containing 12 to 14 carbon atoms and X is as defined above, or b2) 0 to 70% by weight of alkyl ether sulfates corresponding to formula (III):

$$R^3O(CH_2CH_2)_nSO_3X \quad (III)$$

in which $R^3$ is an alkyl radical containing 16 to 18 carbon atoms, n is a number of 1 to 3 and X is as defined above, with a water-containing paste of an alkyl sulfate corresponding to formula (II) to provide a ratio by weight of inner surfactant core to coating of 99.5:0.5 to 90:10.

7. The process of claim 6 conducted in a mixer or drying apparatus.

8. The process of claim 6 wherein at least 90% by weight of said granules have a diameter of 0.2 to 1.4 mm.

9. The process of claim 6 wherein said alkyl sulfates corresponding to formula (II) have a degree of sulfonation of 60 to 80%.

10. The process of claim 6 wherein said component a) is selected from the group consisting of cetyl sulfate, stearyl sulfate, tallow alkyl sulfate, and mixtures thereof.

11. The process of claim 6 wherein said component b2) contains 1 to 3 ethylene oxide units.

12. The process of claim 6 wherein said coating is selected from the group consisting of lauryl sulfate, myristyl sulfate, and mixtures of cocoalkyl sulfate.

* * * * *